US006177851B1

(12) United States Patent
Komatsu

(10) Patent No.: US 6,177,851 B1
(45) Date of Patent: Jan. 23, 2001

(54) HIGH-FREQUENCY ELECTRONIC DEVICE

(75) Inventor: Michihiro Komatsu, Fukushima-ken (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/301,089

(22) Filed: Apr. 28, 1999

(30) Foreign Application Priority Data

May 6, 1998 (JP) ..... 10-123114

(51) Int. Cl.[7] ..... H01P 1/20; H01R 17/04
(52) U.S. Cl. ..... 333/202; 439/675
(58) Field of Search ..... 333/202; 439/131, 439/578, 675

(56) References Cited

U.S. PATENT DOCUMENTS

| | | | | |
|---|---|---|---|---|
| 3,783,321 | | 1/1974 | Patterson . | |
| 5,407,366 | | 4/1995 | Briones et al. . | |
| 5,608,415 | * | 3/1997 | Sugawara | 333/202 |
| 5,801,602 | * | 9/1998 | Fawal et al. | 333/177 |
| 5,928,009 | * | 7/1999 | Lee | 439/131 |

FOREIGN PATENT DOCUMENTS

| | | |
|---|---|---|
| 62-104637 | 5/1987 | (JP) . |
| 6-97781 | 4/1994 | (JP) . |

* cited by examiner

*Primary Examiner*—Robert Pascal
*Assistant Examiner*—Patricia T. Nguyen
(74) *Attorney, Agent, or Firm*—Brinks Hofer Gilson & Lione

(57) ABSTRACT

A high-frequency electronic device is disclosed which can be reduced in thickness without performance deterioration and increase of product price. The high-frequency electronic device comprises a coaxial type connector and a shielding case which is in the shape of a rectangular parallelepiped, the connector having a short diameter and a long diameter in a cross section thereof, the shielding case having a side face which has short sides and long sides. The connector is attached to the side face of the shielding case so that the direction of its short diameter and the direction of the short sides of the shielding case side face are parallel to each other. A filter having a predetermined nominal impedance is disposed within the shielding case, and a central conductor of the connector and the filter are connected with each other through an inductor which is for impedance matching of the connector and the filter.

2 Claims, 2 Drawing Sheets

HIGH-FREQUENCY ELECTRONIC DEVICE

BACKGROUND OF THE INVENTION

1. Field of the Invention

The present invention relates to a high-frequency electronic device such as a television tuner.

2. Description of the Prior Art

A conventional high-frequency electronic device will now be described with reference to FIGS. 4 and 5. FIG. 4 is a perspective view of a conventional high-frequency electronic device and FIG. 5 is an explanatory diagram showing a circuit configuration of the conventional high-frequency electronic device.

In the conventional high-frequency electronic device, as shown in FIG. 4, a coaxial connector 22 is attached to one side face 21*a* of a shielding case 21 which houses high-frequency circuits therein, with a signal being inputted to the connector 22 from a coaxial cable (not shown). Within the shielding case 21, as shown in FIG. 5, there are provided high-frequency circuits such as a band pass filter 23 consisting of a high-pass filter and a low-pass filter, a first mixer 24, a second mixer 25, a first local oscillator 26 and a second local oscillator 27. Frequency conversion is performed twice by means of the first and second mixers 24, 25 and an intermediate frequency signal is outputted from the second mixer 25.

The high-frequency circuits provided within the shielding case 21 are each designed to be impedance-matched usually at 75 Ω (ohms) or 50 Ω. Therefore, the connector 22 is also designed to be 75 Ω or 50 Ω in characteristic impedance. A central conductor 22*a* of the connector 22 and the band pass filter are directly connected with each other, the connector and the band pass filter are impedance-matched, and a signal inputted to the connector 22 is applied to the band pass filter.

The coaxial cable connected to the connector 22 is designed to have a predetermined diameter (thickness) because it is necessary to diminish the transmission loss. Therefore, as the connector there is used one whose diameter corresponds to the diameter of the coaxial cable.

In the conventional high-frequency electronic device described above, the height of the side face 21*a* of the shielding case 21 with the connector 22 attached thereto cannot be made lower than the diameter of the connector 22. For this reason, it has so far been impossible to thin high-frequency electronic devices such as a television tuner to be mounted in a personal computer.

The purpose of thinning the devices can be achieved by using a coaxial connector of a small diameter. However, the use of a (thin) coaxial cable of a small diameter results in an increase in transmission loss of a received signal. On the other hand, using a coaxial cable of a large diameter requires the use of another connector for the connection of the connector 22 with the coaxial cable, thus leading to an increase in price of the high-frequency electronic device concerned.

In view of the above-mentioned problems it is an object of the present invention to provide a high-frequency electronic device capable of being reduced in thickness without deterioration of performance and increase of product cost.

SUMMARY OF THE INVENTION

According to the present invention, for achieving the above-mentioned object, there is provided a high-frequency electronic device comprising a coaxial type connector and a shielding case which is in the shape of a rectangular parallelepiped, the coaxial type connector having a short diameter and a long diameter in a cross section thereof, the shielding case having a side face which has short sides and long sides, the connector being attached to the side face so that the direction of its short diameter and the direction of the short sides of the side face are parallel to each other, and wherein a filter having a predetermined nominal impedance is disposed within the shielding case, and a central conductor of the connector and the filter are connected with each other using an inductor which is for impedance matching of the connector and the filter.

In the high-frequency electronic device of the present invention, the length of each short side of the side face and the short diameter of the connector are almost equal to other.

DETAILED DESCRIPTION OF A PREFERRED EMBODIMENT

Figure 1:
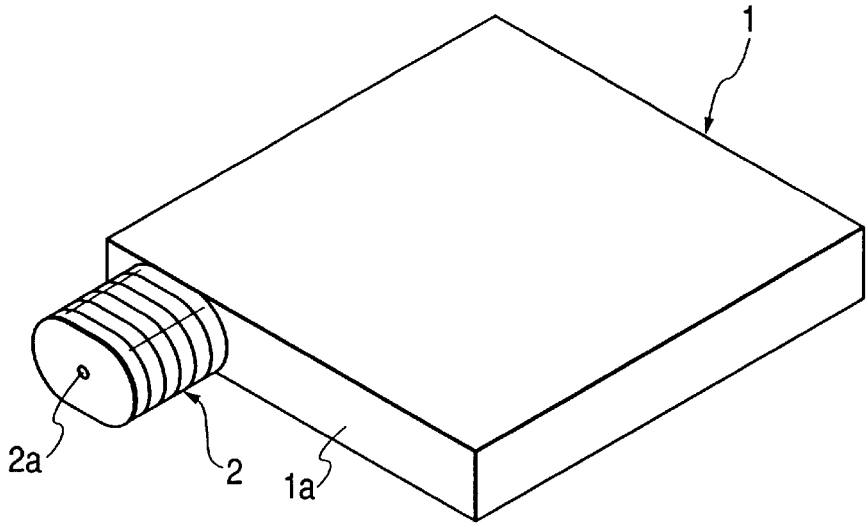
FIG. 1 is a perspective view of a high-frequency electronic device embodying the present invention.
Figure 2:
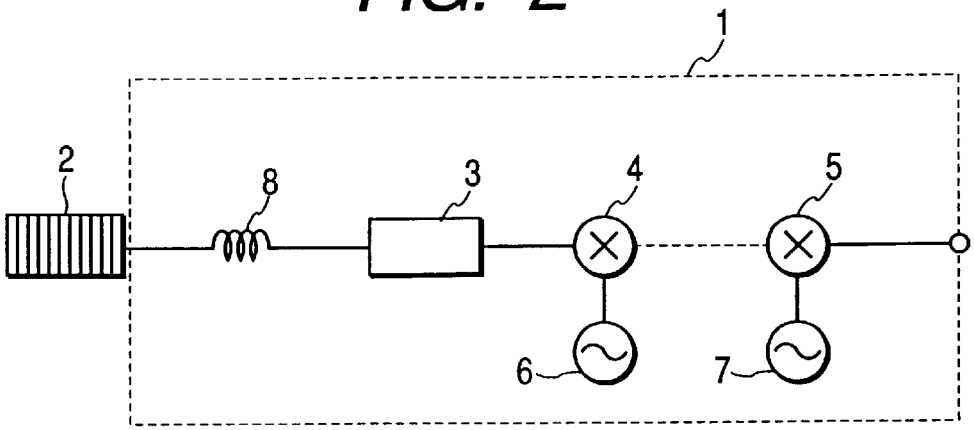
FIG. 2 is an explanatory diagram showing a circuit configuration of the high-frequency electronic device.
Figure 3:
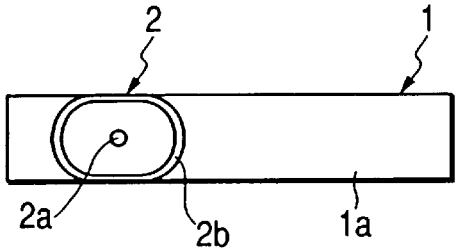
FIG. 3 is an explanatory diagram showing a sectional shape of a connector used in the high-frequency electronic device.
Figure 4:
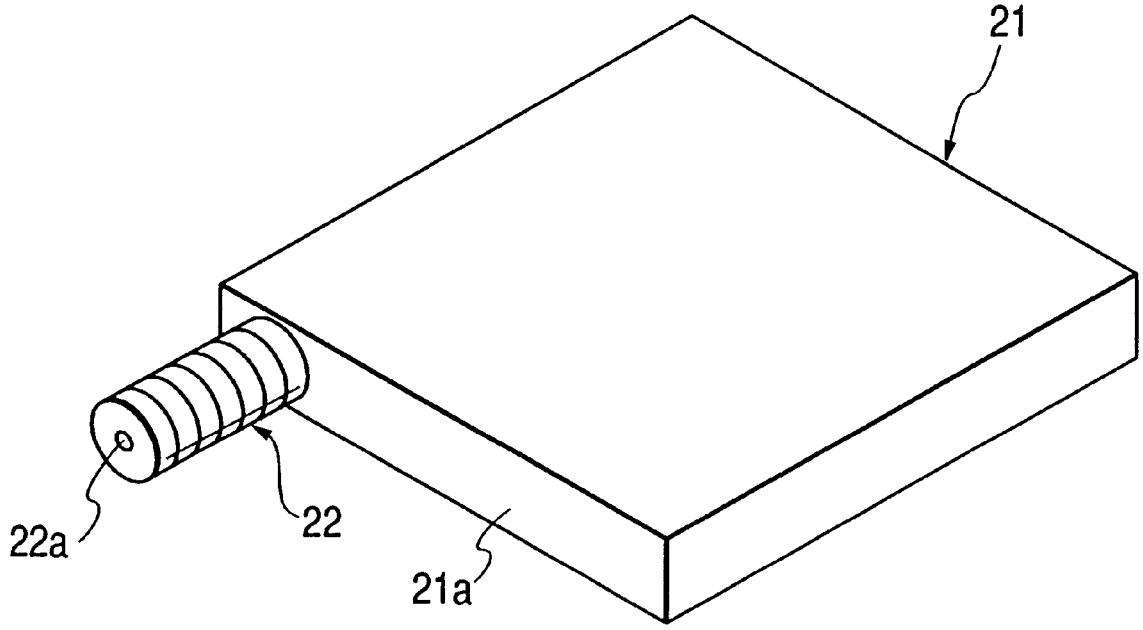
FIG. 4 PRIOR ART
FIG. 4 is a perspective view of a conventional high-frequency electronic device.
Figure 5:
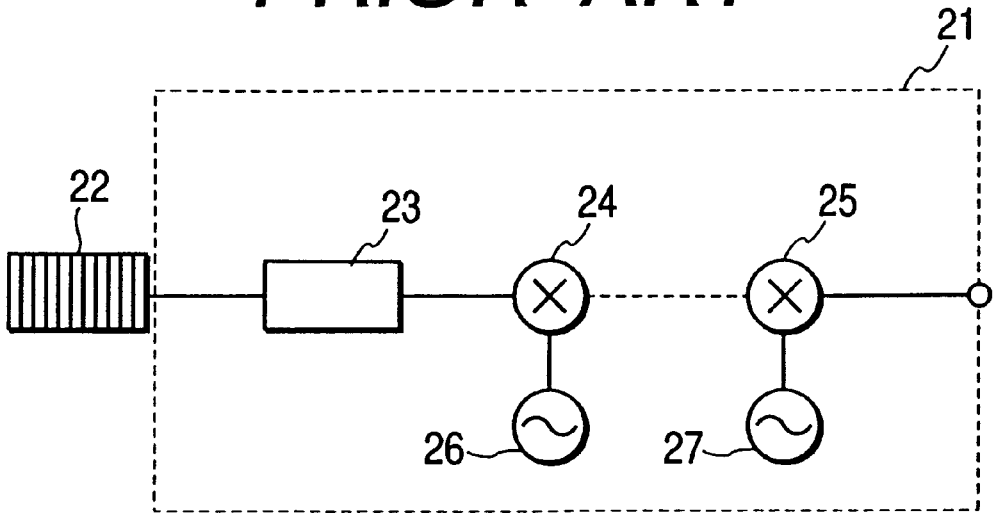
FIG. 5 PRIOR ART
FIG. 5 is an explanatory diagram showing a circuit configuration of the conventional high-frequency electronic device.

A high-frequency electronic device embodying the present invention will be described hereinunder with reference to FIGS. 1 to 3, of which FIG. 1 is a perspective view of the high-frequency electronic device, FIG. 2 is an explanatory diagram showing a circuit configuration of the same device, and FIG. 3 is an explanatory diagram showing a sectional shape of a connector used in the same device.

As shown in FIG. 1, the high-frequency electronic device comprises a shielding case 1 which houses high-frequency circuits therein and a coaxial type connector 2 attached to a side face 1*a* of the shielding case. The shielding case 1 is in the shape of a rectangular parallelepiped, the side face la of which has short sides and long sides.

On the other hand, as shown in FIG. 3, the connector 2 has an inner conductor 2*a*, an outer conductor 2*b*, and an insulator 2*c* disposed between the inner conductor 2*a* and outer conductor 2*b*. The connector 2 is of an oval or elliptic sectional shape having a short diameter and a long diameter.

The connector 2 is attached to the side face 1*a* of the shielding case 1 in such a manner that the direction of the short diameter of the connector and the direction of the short sides of the side face la are parallel to each other. As shown in FIGS. 1 and 3, the length of the short diameter of the connector 2 and the length of each short side of the side face la of the shielding case 1 are almost equal to each other.

A signal is inputted to the connector 2 through a coaxial cable (not shown) having a predetermined diameter (thickness).

Within the shielding case 1, as shown in FIG. 3, there are provided a band pass filter 3 consisting of a high-pass filter and a low-pass filter, a first mixer 4, a second mixer 5, a first local oscillator 6, and a second local oscillator 7. Frequency conversion is performed twice by the first and second mixers

4, 5 and an intermediate frequency signal is outputted from the second mixer 5.

The central conductor 2*a* of the connector 2 is connected to the band pass filter 3 through an inductor 8.

Each of the high-frequency circuits disposed within the shielding case 1, e.g. band pass filter 3, is designed to be impedance-matched usually at 75 Ω (ohms) or 50 Ω.

Since the connector 2 is oval-shaped or elliptic in its cross section, the spacing between the central conductor 2*a* and the outer conductor 2*b* is narrower in the short diameter direction of the connector and the capacitance between the inner and outer conductors 2*a*, 2*b* increases. As a result, the characteristic impedance of the connector 2 becomes lower than that of a conventional circular connector 22 which has an outside diameter equal to the long diameter.

In this embodiment, in view of the point just mentioned above, the central conductor 2*a* of the connector 2 and the band pass filter 3 are connected in series through the inductor 8 to increase the impedance on the connector 2 side including the inductor 8 so that the connector and the band pass filter 3 can be impedance-matched.

In the high-frequency electronic device according to the present invention, even if the sectional shape of the connector 2 is made oval-like or elliptic, it is possible to use a coaxial cable which is applied to a conventional circular coaxial type connector having the same diameter as the aforesaid long diameter, so the high-frequency electronic device does not undergo any performance deterioration caused by transmission loss and is reduced in thickness.

Further, by making the length of the short diameter of the connector 2 and that of each short side of the shielding case side face 1*a* equal to each other, it is possible to minimize the thickness of the shielding case 1.

According to the high-frequency electronic device of the present invention, as set forth above, the same device comprises a coaxial type connector having a short diameter and a long diameter in a cross section thereof and a shielding case which is in the shape of a rectangular parallelepiped, the shielding case having a side face which has short sides and long sides, the connector being attached to the side face so that the direction of its short diameter and the direction of the short sides of the side face are parallel to each other, a filter having a predetermined nominal impedance is provided within the shielding case, and a central conductor of the connector and the filter are connected with each other through an inductor which is for impedance matching of the connector and the filter. Therefore, it is possible to use a coaxial cable which is applied to a conventional circular coaxial type connector having the same diameter as the long diameter. Thus, in the high-frequency electronic device of the present invention there is no fear of performance deterioration caused by transmission loss; besides, the thickness thereof is reduced.

More particularly, the thickness of the shielding case can be minimized because the length of each short side of the shielding case side face and the short diameter of the connector are made almost equal to each other.

What is claimed is:

1. A high-frequency electronic device comprising:

a coaxial type connector;

a shielding case which is in the shape of a rectangular parallelepiped, said coaxial type connector having a short diameter and a long diameter in a cross section thereof, said shielding case having a side face which has short sides and long sides, said connector being attached to said side face of the shielding case so that the direction of the short diameter of the connector and the direction of the short sides of said side face are parallel to each other;

a filters having a predetermined nominal impedance, disposed within said shielding case; and a single inductor for impedance matching of the connector and the filter, said inductor being connected in series between a central conductor of said connector and an input terminal of said filter.

2. A high-frequency electronic device according to claim 1, wherein the length of each said short side of said side face and said short diameter of said connector are almost equal to each other.

* * * * *

UNITED STATES PATENT AND TRADEMARK OFFICE

CERTIFICATE OF CORRECTION

PATENT NO. : 6,177,851 B1
DATED : January 23, 2001
INVENTOR(S) : Michihiro Komatsu It is certified that error appears in the above-identified patent and that said Letters Patent is hereby corrected as shown below:

Claim 1,
Line 12, change "a filters having" to -- a filter having --.

Signed and Sealed this

Eighteenth Day of December, 2001

*Attest:*

*Attesting Officer*

JAMES E. ROGAN
*Director of the United States Patent and Trademark Office*